US008381493B2

(12) United States Patent
Nishiura et al.

(10) Patent No.: US 8,381,493 B2
(45) Date of Patent: Feb. 26, 2013

(54) METHOD OF PACKAGING COMPOUND SEMICONDUCTOR SUBSTRATES

(75) Inventors: Takayuki Nishiura, Itami (JP); Yoshio Mezaki, Itami (JP); Yoshiki Yabuhara, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 272 days.

(21) Appl. No.: 12/412,368

(22) Filed: Mar. 27, 2009

(65) Prior Publication Data

US 2009/0249747 A1 Oct. 8, 2009

(30) Foreign Application Priority Data

Apr. 2, 2008 (JP) ..... 2008-095923

(51) Int. Cl.
*B65B 31/02* (2006.01)

(52) U.S. Cl. ..... 53/408; 53/400; 53/432; 53/434; 53/403; 53/404; 53/405; 53/406; 53/407; 53/79; 53/80; 53/81; 53/82; 53/83; 53/84; 53/85; 53/86; 53/87; 53/88; 53/89; 53/90; 53/91; 53/92; 53/93; 53/94; 53/95; 53/96; 53/97; 53/98; 53/99; 53/100; 53/101; 53/102; 53/103; 53/104; 53/105; 53/106; 53/107; 53/108; 53/109; 53/110; 206/710

(58) Field of Classification Search ..... 206/710; 53/79–110, 400, 403–408, 432, 434, 449
See application file for complete search history.

(56) References Cited

U.S. PATENT DOCUMENTS 3,461,537 A * 8/1969 Johannes ..... 438/460
6,155,027 A * 12/2000 Brooks ..... 53/434
6,164,454 A * 12/2000 Freund et al. ..... 206/706
7,749,768 B2 * 7/2010 Havens et al. ..... 436/172
2002/0174627 A1 * 11/2002 Kitamura et al. ..... 53/400
2004/0131806 A1 * 7/2004 Barmore et al. ..... 428/34.2
2005/0218508 A1 * 10/2005 Fitzgerald et al. ..... 257/720
2005/0236298 A1 * 10/2005 Schwenk et al. ..... 206/710

(Continued)

FOREIGN PATENT DOCUMENTS

CN 1210776 C 7/2005
JP H05-166785 A 7/1993

(Continued)

*Primary Examiner* — Lindsay Low
*Assistant Examiner* — Eyamindae Jallow
(74) *Attorney, Agent, or Firm* — James W. Judge

(57) ABSTRACT

Affords a compound semiconductor substrate packaging method for preventing oxidation of the surface of compound semiconductor substrates. The compound semiconductor substrate packaging method provides: a first step of inserting a compound semiconductor substrate (10) into a gas-permeable, rigid container (20), placing the rigid container (20) into an inner-packing pouch (30) having an oxygen transmission rate of 1 to 100 $ml \cdot m^{-2} \cdot day^{-1} \cdot atm^{-1}$, and a moisture transmission rate of 1 to 15 $g \cdot m^{-2} \cdot day^{-1}$, replacing the air inside the inner-packing pouch (30) with an inert gas, and hermetically sealing the inner-packing pouch; and a second step of placing the sealed inner-packing pouch (30), and a deoxygenating/dehydrating agent (40) that at least either absorbs or adsorbs oxygen gas and moisture, into an outer-packing pouch (60) that has an oxygen transmission rate that is 5 $ml \cdot m^{-2} \cdot day^{-1} \cdot atm^{-1}$ or less and is lower than that of the inner-packing pouch (30), and a moisture transmission rate that is 3 $g \cdot m^{-2} \cdot day^{-1}$ or less and is lower than that of the inner-packing pouch (30), and hermetically sealing the outer-packing pouch (60).

8 Claims, 1 Drawing Sheet

U.S. PATENT DOCUMENTS

| | | | | |
|---|---|---|---|---|
| 2006/0011509 | A1* | 1/2006 | White | 206/714 |
| 2007/0251391 | A1* | 11/2007 | Thomas | 96/135 |
| 2008/0127610 | A1* | 6/2008 | Bosch | 53/244 |
| 2008/0313895 | A1* | 12/2008 | Higuchi et al. | 29/841 |
| 2010/0293892 | A1* | 11/2010 | Curry et al. | 53/403 |

FOREIGN PATENT DOCUMENTS

| | | | |
|---|---|---|---|
| JP | H10-284584 | A | 10/1998 |
| JP | 2003-175906 | A | 6/2003 |
| JP | 2005-029233 | A | 2/2005 |

* cited by examiner

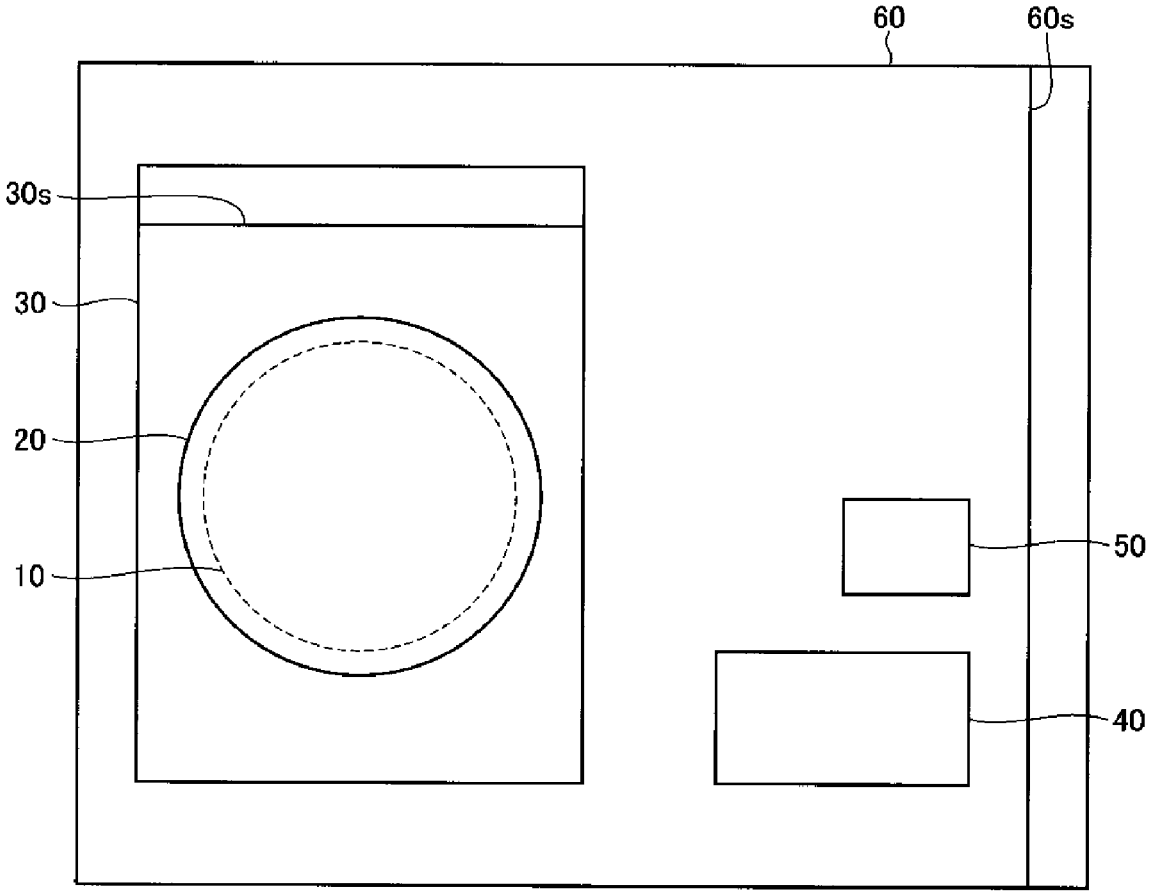
60
60s
30s
30
20
10
50
40

METHOD OF PACKAGING COMPOUND SEMICONDUCTOR SUBSTRATES

BACKGROUND OF THE INVENTION

1. Technical Field

The present invention relates to compound-semiconductor-substrate packaging methods for preventing degradation in quality during storage of compound semiconductor substrates employed in semiconductor device manufacturing.

2. Description of the Related Art

Methods whereby compound semiconductor substrates are stored within a non-oxidizing atmosphere so that the compound semiconductor substrates will not give rise to oxidation or other detriment to quality during storage have been proposed. For example, Japanese Unexamined Pat. App. Pub. No. 2003-175906 discloses a method of packaging semiconductor wafers in which a semiconductor-wafer-storing container and a deoxygenating/dehydrating agent are put into a bag having gas-barrier properties, top of the bag is hermetically sealed, and the bag is kept sealed for a time period sufficient for the oxygen and moisture in the wafer container interior and the bag interior to be absorbed by the deoxygenating/dehydrating agent, after which, with the sealed state left undisturbed, the bag is isolated by a sealing-off partition into a zone in the pouch interior where the wafer container is present and a zone therein where the deoxygenating/dehydrating agent is present.

A problem with the semiconductor wafer packaging method of Pat. App. Pub. No. 2003-175906, however, is that it includes a step whereby the wafer container, which is not gastight, and the deoxygenating/dehydrating agent are sealed into the same space, and because the deoxygenating/dehydrating agent, which is ordinarily a fine powder, gives off particles, impurities from the rising particles adhere to the semiconductor wafers.

What is more, the problem of raising particles from the deoxygenating/dehydrating agent can make it impossible to reduce pressure of the interior of a pouch into which a wafer container has been inserted together with a deoxygenating/dehydrating agent, on account of which a large volume of oxygen and moisture will remain in the pouch interior. A considerable amount of time is necessary for the deoxygenating/dehydrating agent to remove such large volume of oxygen and/or moisture, and in the meantime the surface of the semiconductor wafers is consequently liable to oxidize.

Also, so as to make it possible to form a gastight closure in the pouch by means of a heat seal, at least a sealing portion of the pouch is formed from polyethylene (PE), which has a high oxygen transmission rate, as a consequence of which when semiconductor wafers are stored for long periods, oxygen and/or water enters the pouch interior through the sealing portion, leaving the semiconductor wafers susceptible to surface oxidation.

Still further, with compound semiconductor substrates, one or more epitaxial layers is grown onto the front surface without, ordinarily, any special treatment of the substrate surface being carried out. A problem therein has been that should a thick oxidation layer form on the front surface of the compound semiconductor substrate, oxygen remains behind at the interface between the substrate and the epitaxial layer grown onto its front surface, which is deleterious to device properties.

BRIEF SUMMARY OF THE INVENTION

An object of the present invention, in order to resolve the problems discussed above, is to make available a compound semiconductor substrate packaging method for preventing oxidation of the surface of compound semiconductor substrates.

The present invention provides: a first step of inserting a compound semiconductor substrate into a gas-permeable, rigid container, placing the rigid container into an inner-packing pouch having an oxygen transmission rate of 1 to 100 $ml \cdot m^{-2} \cdot day^{-1} \cdot atm^{-1}$, and a moisture transmission rate of 1 to 15 $g \cdot m^{-2} \cdot day^{-1}$, replacing the air inside the inner-packing pouch with an inert gas, and hermetically sealing the inner-packing pouch; and a second step of placing the sealed inner-packing pouch, and a deoxygenating/dehydrating agent that absorbs or adsorbs at least either oxygen gas and moisture (for example, water), into an outer-packing pouch that has an oxygen transmission rate that is 5 $ml \cdot m^{-2} \cdot day^{-1} \cdot atm^{-1}$ or less and is lower than that of the inner-packing pouch, and a moisture transmission rate that is 3 $g \cdot m^{-2} \cdot day^{-1}$ or less and is lower than that of the inner-packing pouch, and hermetically sealing the outer-packing pouch.

In the first step of a compound semiconductor substrate packaging method involving the present invention, the operation of replacing the air inside the inner-packing pouch with an inert gas can be carried out by means of an operation in which a vacuum is drawn on the inner-packing pouch by exhausting the air inside, after which an inert gas is flowed into the inner-packing pouch. Furthermore, in the first step of a compound semiconductor substrate packaging method involving the present invention, the pressure of the air inside the inner-packing pouch after a vacuum is drawn on the inner-packing pouch by exhausting the air inside, but prior to flowing the inert gas into the inner-packing pouch, may be 15 torr or less.

In a compound semiconductor substrate packaging method involving the present invention, it is possible to have the outer-packing pouch be transparent, and in the second step, to also place into the outer-packing pouch an oxygen/moisture indicator that indicates the concentration of at least either oxygen gas or moisture (for example, water).

The present invention affords methods of packaging compound semiconductor substrates for preventing oxidation of the compound semiconductor substrate surfaces.

BRIEF DESCRIPTION OF THE DRAWING

The FIGURE is an outline plan view for illustrating a semiconductor substrate packaging method involving the present invention.

| Explanation of Reference Marks | |
|---|---|
| 10: | compound semiconductor substrate |
| 20: | rigid container |
| 30: | inner-packing pouch |
| 30s, 60s: | heat-sealing section |
| 40: | deoxygenating/dehydrating agent |
| 50: | oxygen/moisture indicator |
| 60: | outer-packing pouch |

DETAILED DESCRIPTION OF THE INVENTION

Embodiment Mode 1

Reference is made to the FIGURE. A compound semiconductor substrate packaging method that is one mode of embodying the present invention provides: a first step of inserting a compound semiconductor substrate 10 into a gas-permeable and rigid container 20, placing the rigid container 20 into an inner-packing pouch 30 having an oxygen transmission rate of 1 to 100 $ml \cdot m^{-2} \cdot day^{-1} \cdot atm^{-1}$, and a moisture transmission rate of 1 to 15 $g \cdot m^{-2} \cdot day^{-1}$, replacing the air inside the inner-packing pouch 30 with an inert gas, and hermetically sealing the inner-packing pouch 30; and a second step of inserting the sealed inner-packing pouch 30, and a deoxygenating/dehydrating agent 40 that at least either absorbs or adsorbs oxygen gas and moisture, into an outer-packing pouch 60 that has an oxygen transmission rate that is 5 $ml \cdot m^{-2} \cdot day^{-1} \cdot atm^{-1}$ or less and is lower than that of the inner-packing pouch 30, and a moisture transmission rate that is 3 $g \cdot m^{-2} \cdot day^{-1}$ or less and is lower than that of the inner-packing pouch 30, and hermetically sealing the outer-packing pouch 60.

By virtue of the method, involving the present invention, of packaging compound semiconductor substrates, because the rigid container 20 into which a compound semiconductor substrate 10 has been inserted is segregated from the deoxygenating/dehydrating agent 40 by the inner-packing pouch 30, impurities due to dust emission from the deoxygenating/dehydrating agent 40 do not adhere to the compound semiconductor substrate 10 inserted into the rigid container 20. In addition, because the inner-packing pouch 30 into which is placed the rigid container 20 into which the compound semiconductor substrate 10 is inserted has an oxygen transmission rate of 1 to 100 $ml \cdot m^{-2} \cdot day^{-1} \cdot atm^{-1}$, and a moisture transmission rate of 1 to 15 $g \cdot m^{-2} \cdot day^{-1}$, and because the outer-packing pouch 60 into which are placed the inner-packing pouch 30 and the deoxygenating/dehydrating agent 40 has an oxygen transmission rate that is 5 $ml \cdot m^{-2} \cdot day^{-1} \cdot atm^{-1}$ or less and is lower than that of the inner-packing pouch, and a moisture transmission rate that is 3 $g \cdot m^{-2} \cdot day^{-1}$ or less and is lower than that of the inner-packing pouch 30, oxygen gas and/or moisture inside the inner-packing pouch 30, wherein is disposed the rigid container 20 into which the compound semiconductor substrate 10 has been inserted, is removed by the deoxygenating/dehydrating agent 40, disposed inside the outer-packing pouch 60 yet outside the inner-packing pouch 30, therefore making it possible to prevent the surface of the compound semiconductor substrate from oxidizing.

Compound Semiconductor Substrate

The compound semiconductor substrate 10 that is what is packaged in the present invention is not particularly limited, but preferably may be a Group III-V semiconductor substrate such as an AlN substrate, a GaN substrate, an InN substrate, an $Al_xGa_yIn_{1-x-y}N$ ($0<x<1$, $0<y<1$) substrate, a GaAs substrate, an $Al_zGa_{1-z}As$ ($0<z<1$) substrate, or an InP substrate. Such Group III-V substrates, which are polished to a mirror-like finish and cleansed to clear their surface impurities thoroughly away, are ideally suited to a packaging method involving the present invention, because the substrate surface immediately post-manufacture, with its Group III-V atoms exposed, is left in an extremely active state in which the surface is susceptible to oxidizing.

Rigid Container

In the present invention, the rigid container 20 utilized for holding the compound semiconductor substrate 10 is a gas-permeable rigid container. The rigid container 20 being gas-permeable lets the deoxygenating/dehydrating agent 40 disposed outside the rigid container 20 (and outside the inner-packing pouch 30 as well) remove moisture and oxygen gas from the interior of the rigid container 20. And inasmuch as it is a rigid container, it protects the compound semiconductor substrate 10, preventing the substrate from damage or other detriment. From these perspectives, a polypropylene (PP) container, polycarbonate (PC) container, or polybutyl terephthalate (PBT) container, for example, is preferably utilized as the rigid container 20.

Furthermore, utilizing a transparent container as the rigid container 20 makes it possible to visually check over the compound semiconductor substrate 10 having been inserted into the rigid container 20.

Inner-Packing Pouch

The inner-packing pouch 30 utilized in the present invention has an oxygen transmission rate of 1 to 100 $ml \cdot m^{-2} \cdot day^{-1} \cdot atm^{-1}$, and a moisture transmission rate of 1 to 15 $g \cdot m^{-2} \cdot day^{-1}$. If the oxygen transmission rate of the inner-packing pouch 30 is lower than 1 $ml \cdot m^{-2} \cdot day^{-1} \cdot atm^{-1}$, or if its moisture transmission rate is lower than 1 $g \cdot m^{-2} \cdot day^{-1}$, then even with the deoxygenating/dehydrating agent 40 disposed outside the inner-packing pouch 30 and inside the outer-packing pouch 60, eliminating moisture and oxygen gas inside the inner-packing pouch 30 becomes problematic, such that the surface of the compound semiconductor substrate 10 inserted into the rigid container 20 oxidizes. If the oxygen transmission rate of the inner-packing pouch 30 is higher than 100 $ml \cdot m^{-2} \cdot day^{-1} \cdot atm^{-1}$, or if its moisture transmission rate is higher than 15 $g \cdot m^{-2} \cdot day^{-1}$, then even with the deoxygenating/dehydrating agent 40 disposed outside the inner-packing pouch 30 and inside the outer-packing pouch 60, moisture and oxygen gas outside the inner-packing pouch 30, but inside the outer-packing pouch 60, invade the interior of the inner-packing pouch 30 before they can be removed by the deoxygenating/dehydrating agent 40, such that the surface of the compound semiconductor substrate 10 inserted into the rigid container 20 oxidizes.

As long as it has an oxygen transmission rate of 1 to 100 $ml \cdot m^{-2} \cdot day^{-1} \cdot atm^{-1}$, and a moisture transmission rate of 1 to 15 $g \cdot m^{-2} \cdot day^{-1}$, the inner-packing pouch 30 is not particularly limited, but preferable examples that may be given include: an $Al_2O_3$ ceramic-coated polyethylene (PE) pouch; an $SiO_2$ ceramic-coated PE pouch; a polyethylene terephthalate (PET) pouch; a PE pouch coated with vacuum-deposited aluminum; a PET/PE laminate pouch; a polyamide/polyvinylidene-chloride/PE laminate pouch; a polyamide/PE-incorporating-silica-particles/PE laminate pouch; and a polyamide/vacuum-deposited-alumina (aluminum-oxide)/PE laminate pouch.

Furthermore, utilizing a transparent pouch as the inner-packing pouch 30 makes it possible to visually check over the rigid container 20 having been placed into the inner-packing pouch 30.

Inert Gas

The inert gas utilized in the present invention is not particularly limited as long as it is a gas with minimal oxygen and moisture content. And from a safety-in-handling perspective, preferably it is a low-reactivity gas. From these perspectives, the inert gas may be, to cite preferable examples, nitrogen or argon gas.

Deoxygenating/Dehydrating Agent

The deoxygenating/dehydrating agent 40 utilized in the present invention refers to a substance that rids the inside of the outer-packing pouch 60 of at least oxygen gas and/or moisture, and may be a substance that can remove, in addition to oxygen gas and/or moisture, hydrogen sulfide, sulfurous acid, hydrogen chloride, ammonia gas, and other gases that are harmful to compound semiconductor substrates. The deoxygenating/dehydrating agent 40 may be, to give examples, an oxygen absorbent or a desiccant. Oxygen absorbents are substances that remove oxygen gas through absorption by reacting with the oxygen chemically, and include, to cite a few examples, Fe powders, ascorbic acid salts, and sulfurous acid salts. It will be appreciated that among oxygen absorbents are substances that can also absorb moisture together with oxygen gas. Desiccants are substances that remove moisture by adsorbing or absorbing it physically or chemically, and examples that may be given include silica gel, synthetic zeolites (for example, $Na_{12}[(AlO_2)\cdot(SiO_2)]_{12}\cdot 27H_2O$, etc.), anhydrous calcium sulphate, molecular sieves, activated alumina (activated aluminum oxide), and magnesium chloride. From the perspectives of preventing incursion into the inner-packing pouch and of improving operability, the deoxygenating/dehydrating agent 40 is preferably housed in a sachet that is gas-permeable.

Outer-Packing Pouch

The outer-packing pouch 60 utilized in the present invention has an oxygen transmission rate that is 5 $ml\cdot m^{-2}\cdot day^{-1}\cdot atm^{-1}$ or less and is lower than that of the inner-packing pouch, and a moisture transmission rate that is 3 $g\cdot m^{-2}\cdot day^{-1}$ or less and is lower than that of the inner-packing pouch. If the oxygen transmission rate of the outer-packing pouch 60 is higher than 5 $ml\cdot m^{-2}\cdot day^{-1}\cdot atm^{-1}$, or if its moisture transmission rate is higher than 3 $g\cdot m^{-2}\cdot day^{-1}$, then even with the deoxygenating/dehydrating agent 40 disposed inside the outer-packing pouch 60 and outside the inner-packing pouch, eliminating moisture and oxygen gas inside the outer-packing pouch 60 (inside the outer-packing pouch 60, as well as outside the inner-packing pouch 30 and inside the inner-packing pouch) becomes problematic. Likewise, the oxygen transmission rate or moisture transmission rate of the outer-packing pouch 60 being greater than that of the inner-packing pouch 30 is, even with the deoxygenating/dehydrating agent 40 disposed inside the outer-packing pouch 60 and outside the inner-packing pouch 30, prohibitive of eliminating oxygen and moisture from inside the inner-packing pouch 30.

As long as it has an oxygen transmission rate that is 5 $ml\cdot m^{-2}\cdot day^{-1}\cdot atm^{-1}$ or less and is lower than that of the inner-packing pouch, and a moisture transmission rate that is 3 $g\cdot m^{-2}\cdot day^{-1}$ or less and is lower than that of the inner-packing pouch, the outer-packing pouch 60 is not particularly limited, but preferable examples that may be given include: a polyethylene (PE) pouch coated with vacuum-deposited aluminum; a PE pouch coated with vacuum-deposited alumina (aluminum oxide); a PE pouch coated with vacuum-deposited silica; a polyamide/aluminum-foil/PE laminate pouch; a polyamide/vacuum-deposited-alumina/PE laminate pouch; a polyethylene terephthalate (PET)/vacuum-deposited-silica/PE laminate pouch; a polyamide/vacuum-deposited-silica/PE laminate pouch; and a polyamide/vacuum-deposited-aluminum/PE laminate pouch.

Furthermore, utilizing a transparent pouch as the outer-packing pouch 60 makes it possible to visually check over the inner-packing pouch 30 and the deoxygenating/dehydrating agent 40, having been placed into the outer-packing pouch 60. What is more, when a transparent outer-packing pouch 60 is utilized, by placing an oxygen/moisture indicator 50 as will be described later into the outer-packing pouch 60, the gross oxygen concentration inside the outer-packing pouch 60 can be checked at a glance.

First Step

Reference is made to the FIGURE. A compound semiconductor substrate packaging method involving the present invention provides a first step of placing a compound semiconductor substrate 10 into a gas-permeable, rigid container 20, inserting the rigid container 20 into an inner-packing pouch 30 having an oxygen transmission rate of 1 to 100 $ml\cdot m^{-2}\cdot day^{-1}\cdot atm^{-1}$, and a moisture transmission rate of 1 to 15 $g\cdot m^{-2}\cdot day^{-1}$, replacing the air inside the inner-packing pouch 30 with an inert gas, and hermetically sealing the inner-packing pouch 30.

This first step is specifically carried out as follows. To being with, the compound semiconductor substrate 10 that is to be packaged is inserted into the gas-permeable, rigid container 20. The compound semiconductor substrate 10 is thereby protected by the rigid container 20, to keep it from damage or other detriment.

Next, the rigid container 20 into which the compound semiconductor substrate 10 has been inserted is placed into the inner-packing pouch 30 having an oxygen transmission rate of 1 to 100 $ml\cdot m^{-2}\cdot day^{-1}\cdot atm^{-1}$, and a moisture transmission rate of 1 to 15 $g\cdot m^{-2}\cdot day^{-1}$. Inasmuch as the rigid container 20 is placed into the inner-packing pouch 30, but a deoxygenating/dehydrating agent is not, impurities due to dust emission from a deoxygenating/dehydrating agent adhering to a compound semiconductor substrate having been inserted into the rigid container are nonexistent.

Next, the air inside the inner-packing pouch 30 into which the rigid container 20 holding the compound semiconductor substrate 10 has been placed is replaced with an inert gas, and the inner-packing pouch 30 is hermetically sealed. Inasmuch as the rigid container 20 is placed into the inner-packing pouch 30, but a deoxygenating/dehydrating agent is not, the inner-packing pouch 30 can undergo replacement of its internal air with an inert gas, without being subjected to the influence of dust emission from a deoxygenating/dehydrating agent. Because oxygen gas and moisture inside the inner-packing pouch 30 is removed therefrom, the compound semiconductor substrate 10 surface is kept from being oxidized at least for a short term (for example, inside of 1 month).

Herein, the operation of replacing with an inert gas the air inside the inner-packing pouch 30 into which the rigid container 20 holding the compound semiconductor substrate 10 has been placed is not particularly limited, but is preferably carried out by means of an operation in which a vacuum is drawn on the inner-packing pouch by exhausting the air inside, after which an inert gas is flowed into the inner-packing pouch. Such an operation enables efficient replacement of the air inside the inner-packing pouch 30 with an inert gas. In view of such factors, the pressure of the air inside the inner-packing pouch 30 prior to flowing the inert gas into the inner-packing pouch 30—after a vacuum is drawn on the inner-packing pouch 30 by exhausting the air inside—preferably is 15 torr (2.0 kPa) or less, more preferably 10 torr (1.3 kPa) or less, still more preferably 3 torr (0.4 kPa) or less.

Again, the inert gas flowed into the inner-packing pouch 30 after a vacuum is drawn on the inner-packing pouch 30 by exhausting the air inside is not particularly limited as long as it is a gas with minimal oxygen gas and moisture content, but from the perspective of safety in handling, preferably it is a low-reactivity gas—preferable examples that may be given include nitrogen gas or argon gas.

The method of hermetically sealing the inner-packing pouch 30 after replacing with an inert gas the air inside the inner-packing pouch 30 in the manner just described is not particularly limited, but from the perspective of ease of sealing, making a heat seal in the pouch (meaning heat-sealing it, ditto hereinafter) is preferable. In this way the inner-packing pouch 30 is hermetically sealed by means of a heat-sealing section 30s therein.

Herein, drawing a vacuum on the inner-packing pouch 30 by exhausting the air inside, and continuing on that, flowing an inert gas into the inner-packing pouch 30, and thereon continuing with heat-sealing of the inner-packing pouch 30, can be carried out utilizing a gas-flush (vacuum) packaging machine. Gas-flush packaging machines may include nozzle-based systems and chamber-based systems. "Nozzle-based systems" mean systems in which nozzles for drawing a vacuum by expelling air and for flowing in an inert gas are inserted inside bags individually, and a vacuum is drawn on each bag separately by expelling the air inside it, an inert gas is flowed into the bags, and they are heat-sealed. "Chamber-based systems" mean systems in which bags are placed into a vacuum chamber, a vacuum is drawn on the chamber by expelling the air from the entire interior space, into which an inert gas is then flowed, and in that state the bags are heat sealed.

Second Step

Reference is made to the FIGURE. A compound semiconductor substrate packaging method involving the present invention provides a second step of placing the inner-packing pouch 30 sealed in the above-described first step, and at least either a deoxygenating or dehydrating agent 40, into an outer-packing pouch 60 that has an oxygen transmission rate that is 5 $ml \cdot m^{-2} \cdot day^{-1} \cdot atm^{-1}$ or less and is lower than that of the inner-packing pouch, and a moisture transmission rate that is 3 $g \cdot m^{-2} \cdot day^{-1}$ or less and is lower than that of the inner-packing pouch, and hermetically sealing the outer-packing pouch 60.

This second step is specifically carried out as follows. The inner-packing pouch 30 having been hermetically sealed, and the deoxygenating/dehydrating agent 40 are placed into the outer-packing pouch 60, and the outer-packing pouch 60 is hermetically sealed. The method by which the outer-packing pouch 60 is hermetically sealed herein is not particularly limited, but from the perspective of ease of sealing, heat-sealing of the outer-packing pouch 60 is preferable. In this way the outer-packing pouch 60 is hermetically sealed by means of a heat-sealing section 60s therein.

The inner-packing pouch 30 into which is placed the rigid container 20 holding the compound semiconductor substrate 10, and the deoxygenating/dehydrating agent 40 are placed in the outer-packing pouch 60 having been hermetically sealed in the manner described above, and because the inner-packing pouch 30 has an oxygen transmission rate of 1 to 100 $ml \cdot m^{-2} \cdot day^{-1} \cdot atm^{-1}$, and a moisture transmission rate of 1 to 15 $g \cdot m^{-2} \cdot day^{-1}$, and because the outer-packing pouch 60 has an oxygen transmission rate that is 5 $ml \cdot m^{-2} \cdot day^{-1} \cdot atm^{-1}$ or less and is lower than that of the inner-packing pouch, and a moisture transmission rate that is 3 $g \cdot m^{-2} \cdot day^{-1}$ or less and is lower than that of the inner-packing pouch, oxygen gas and/or moisture inside the inner-packing pouch 30, wherein is disposed the rigid container 20 into which the compound semiconductor substrate 10 has been inserted, is removed by the deoxygenating/dehydrating agent 40, disposed inside the outer-packing pouch yet outside the inner-packing pouch, therefore making it possible to prevent, over a long term (for example, longer than 1 month), the surface of the compound semiconductor substrate from oxidizing.

The FIGURE is rendered to represent a single inner-packing pouch 30, together with a single deoxygenating/dehydrating agent 40, having been placed within the outer-packing pouch 60, but a plurality of inner-packing pouches 30 may be placed therein. Placing a plurality of inner-packing pouches 30, together with a single deoxygenating/dehydrating agent 40, in the outer-packing pouch 60 enables a plurality of compound semiconductor substrates within a plurality of inner-packing pouches to be stored with a single deoxygenating/dehydrating agent, which is both economical and allows the substrates to be used individually, one at a time. A further advantage is convenience when several among a plurality of compound semiconductor substrates are used and the rest stored, because the remaining inner-packing pouches holding the remaining compound semiconductor substrates can be re-stored by placing them anew in a separate outer-packing pouch, together with a single deoxygenating/dehydrating agent 40.

Embodiment Mode 2

Reference is made to the FIGURE. A compound semiconductor substrate packaging method that is another mode of embodying the present invention is a procedure in which, in a packaging method of Embodiment Mode 1, the outer-packing pouch 60 is transparent, and in the second step, an oxygen/moisture indicator 50 that indicates the concentration of at least either oxygen gas or moisture is further placed in the transparent outer-packing pouch 60, together with the sealed inner-packing pouch 30 and the deoxygenating/dehydrating agent 40, and the outer-packing pouch 60 is hermetically sealed. In accordance with this method, considerable convenience is afforded in that the oxygen/moisture indicator makes it possible to know, simply and at a glance, the concentration of oxygen gas and/or moisture inside the outer-packing pouch 60, enabling the storage status of the compound semiconductor substrate(s) to be assessed.

Oxygen/Moisture Indicator

Herein, an oxygen/moisture indicator means a device that will indicate the concentration of at least either oxygen gas or moisture. In the present invention, "indicating the concentration of oxygen gas and/or moisture," not being limited to the display of precise values, may be a gross, high/low display of concentration. For example, a device that according to high/low change in concentration of oxygen gas and/or moisture changes color or makes a similar response is very handy because it enables an overview of the concentration of oxygen gas and/or moisture to be known simply and at a glance. Examples that may be given of oxygen indicators of this sort include mixtures of redox dyes, bases, and reductants, e.g., a mixture of methyl blue/sodium hydroxide/a ferrous compound, or a mixture of methylene green/magnesium hydroxide/glucose. Likewise, examples that may be given of the moisture indicator may be, to cite an example, a material, loaded onto silica gel, in which an oxidative substance and an acid-base indicator are mixed (e.g., phosphoric acid/methyl violet, citric acid/methyl red, etc.).

EMBODIMENT EXAMPLES

1. Surface Processing of Compound Semiconductor Substrate

With reference to the FIGURE: The front surface of nineteen sample GaAs semiconductor substrates (compound semiconductor substrates 10) of 76 mm diameter and 450 μm thickness were CMP (chemical-mechanical planarization) processed employing an aqueous solution of "INSEC NIB," manufactured by Fujimi Inc., and were thereafter alkali washed, or alkali washed and acid washed, after which they were rinsed in pure water and then dried. Therein, as set forth in the table, in respect of Sample Nos. 14 and 16, as the post-CMP wash a strong alkali wash using a 0.1 mol/L (indicating liters, ditto hereinafter) aqueous solution (pH: 11) of tetramethylammonium hydroxide (TMAH—a class of amines) was carried out and, letting that be the final wash, thereafter the samples were rinsed in pure water and dried. And in respect of Sample Nos. 1 through 13, 15, and 17 through 19, as the post-CMP wash a strong alkali wash using a 0.05 mol/L aqueous solution (pH: 11) of triethanol amine was carried out, after which a further, weak-acid wash using a 0.001 mol/L aqueous solution (pH: 4) of nitric acid was performed and, letting that be the final wash, the samples were thereafter rinsed in pure water and dried. GaAs semiconductor substrate Sample Nos. 1 through 19, with front surface RMS roughnesses as set forth in the table, were thereby obtained.

Herein, "RMS roughness" signifies mean-square roughness along the surface, that is, the square-root of a value that is the average taken of the squares of the distance (deflection) from the average surface to the probed curved surface, and is a value that was measured with JIS B0601 as a reference standard. In the present embodiment examples, the RMS roughness was measured using atomic-force microscopy (AFM) in a visual field of 0.2 μm □ (meaning a 0.2 μm×0.2 μm square, ditto hereinafter) along the front surface of the GaAs semiconductor substrates, at a pitch of 0.4 nm or less.

2. First Step

With reference to the FIGURE: The above-described nineteen sample GaAs semiconductor substrates (compound semiconductor substrates 10) were each inserted into a rigid container 20 made of polycarbonate (PC), of 79 mm inner diameter, 100 mm outer diameter, and 10 mm height, the rigid containers 20 were placed into inner-packing pouches 30 of 200 mm length and 150 mm width, and having the oxygen transmission rates and moisture transmission rates set forth in the table, and a chamber-based gas-flush packaging machine was employed to draw a vacuum on the inner-packing pouches 30 by expelling the air inside, down to the pressures indicated in the table, and as an inert gas, nitrogen gas of 99.9 mass % purity was flowed into the inner-packing pouches, which had been set inside the machine chamber. Thereafter the openings of the inner-packing pouches 30 were thermoplastically welded to hermetically seal the inner-packing pouches 30.

Herein, as the inner-packing pouches 30, utilized were: a polyamide/aluminum-foil/PE (polyethylene) laminate pouch having an oxygen transmission rate of 0.01 $ml \cdot m^{-2} \cdot day^{-1} \cdot atm^{-1}$ and a moisture transmission rate of 0.01 $g \cdot m^{-2} \cdot day^{-1}$; a polyamide/vacuum-deposited-silica/PE laminate pouch having an oxygen transmission rate of 0.5 $ml \cdot m^{-2} \cdot day^{-1} \cdot atm^{-1}$ and a moisture transmission rate of 0.7 $g \cdot m^{-2} \cdot day^{-1}$; a polyamide/vacuum-deposited-alumina (aluminum oxide)/PE laminate pouch having an oxygen transmission rate of 2 $ml \cdot m^{-2} \cdot day^{-1} \cdot atm^{-1}$ and a moisture transmission rate of 2 $g \cdot m^{-2} \cdot day^{-1}$; a polyamide/polyvinylidene-chloride/PE laminate pouch having an oxygen transmission rate of 3.5 $ml \cdot m^{-2} \cdot day^{-1} \cdot atm^{-1}$ and a moisture transmission rate of 10 $g \cdot m^{-2} \cdot day^{-1}$; a polyethylene terephthalate (PET) pouch having an oxygen transmission rate of 45 $ml \cdot m^{-2} \cdot day^{-1} \cdot atm^{-1}$ and a moisture transmission rate of 6 $g \cdot m^{-2} \cdot day^{-1}$; a PE pouch coated with vacuum-deposited aluminum, having an oxygen transmission rate of 100 $ml \cdot m^{-2} \cdot day^{-1} \cdot atm^{-1}$ and a moisture transmission rate of 15 $g \cdot m^{-2} \cdot day^{-1}$; and a PE pouch having an oxygen transmission rate of 3000 $ml \cdot m^{-2} \cdot day^{-1} \cdot atm^{-1}$ and a moisture transmission rate of 19 $g \cdot m^{-2} \cdot day^{-1}$.

3. Second Step

With reference to the FIGURE: The nineteen sealed inner-packing pouches 30 obtained in the first step were each placed into outer-packing pouches 60, having the oxygen transmission rates and moisture transmission rates set forth in the table, either together with a deoxygenating/dehydrating agent 40 or unaccompanied by a deoxygenating/dehydrating agent 40, as indicated in the table, and the openings of the outer-packing pouches 60 were thermoplastically welded to hermetically seal the outer-packing pouches 60. Herein, inasmuch as gas-flushing replacement of the air inside the outer-packing pouches 60 is not performed in heat-sealing the outer-packing pouches 60, packaging machines can be employed without particular limitations as long as they are heat-sealing capable.

Herein, the oxygen absorbent entered in the table is 20 g of an "RP agent," manufactured by Mitsubishi Gas Chemical Co., Inc., while the desiccant is 20 g of a silica gel manufactured by Sakurai Co., Ltd.

Meanwhile, as the outer-packing pouches 60, utilized were: a polyamide/aluminum-foil/PE (polyethylene) laminate pouch having an oxygen transmission rate of 0.01 $ml \cdot m^{-2} \cdot day^{-1} \cdot atm^{-1}$ and a moisture transmission rate of 0.01 $g \cdot m^{-2} \cdot day^{-1}$; a polyamide/vacuum-deposited-silica/PE laminate pouch having an oxygen transmission rate of 0.05 $ml \cdot m^{-2} \cdot day^{-1} \cdot atm^{-1}$ and a moisture transmission rate of 0.4 $g \cdot m^{-2} \cdot day^{-1}$; a polyamide/vacuum-deposited-silica/PE laminate pouch having an oxygen transmission rate of 0.5 $ml \cdot m^{-2} \cdot day^{-1} \cdot atm^{-1}$ and a moisture transmission rate of 0.7 $g \cdot m^{-2} \cdot day^{-1}$; a polyamide/vacuum-deposited-aluminum/PE laminate pouch having an oxygen transmission rate of 5 $ml \cdot m^{-2} \cdot day^{-1} \cdot atm^{-1}$ and a moisture transmission rate of 3 $g \cdot m^{-2} \cdot day^{-1}$; and a PE pouch having an oxygen transmission rate of 5000 $ml \cdot m^{-2} \cdot day^{-1} \cdot atm^{-1}$ and a moisture transmission rate of 20 $g \cdot m^{-2} \cdot day^{-1}$.

4. Storing Outer-Packing Pouch Packaging Compound Semiconductor Substrate

The outer-packing pouches 60, into which, in the manner described above, had been packaged the inner-packing pouches 30, themselves encasing the rigid containers 20 holding the GaAs semiconductor substrates (compound semiconductor substrates 10), were stored for a 60-day period within a constant-temperature, constant-humidity vessel at a temperature of 25±5° C. and a relative humidity of 50±15 RH %.

5. Growth of Epitaxial Layers

The GaAs substrates (compound semiconductor substrates 10) were taken out of the outer-packing pouches 60 having been stored as just described, and a 3 μm thick $Al_{0.4}Ga_{0.6}As$ semiconductor epitaxial layer was grown by metalorganic chemical vapor deposition (MOCVD) onto the front surface of the substrates, without the substrate front surfaces having been preparatorily treated. The oxygen concentration at the interface between the substrate and the epitaxial layer in the thus obtained GaAs semiconductor substrates bearing an $Al_{0.4}Ga_{0.6}As$ semiconductor epitaxial layer was characterized by secondary ion mass spectrometry (SIMS). The results are tabulated in the table.

| | | | Inner-packing pouch | | | Outer-packing pouch | | | Post-epi SIMS |
|---|---|---|---|---|---|---|---|---|---|
| No. | RMS roughness (nm/0.2 μm□) | Final wash | Pre-$N_2$ intro. press. (Torr) | Oxygen trans. rate ($ml \cdot m^{-2} \cdot day^{-1} \cdot atm^{-1}$) | Moist. trans. rate ($g \cdot m^{-2} \cdot day^{-1}$) | Deoxygenating/ dehydrating agent pres./absent | Oxygen trans. rate ($ml \cdot m^{-2} \cdot day^{-1} \cdot atm^{-1}$) | Moist. trans. rate ($g \cdot m^{-2} \cdot day^{-1}$) | assay Interface oxy. conc. (atoms/$cm^3$) |
| 1 | 0.110 | Weak acid | 10 | 0.01 | 0.01 | Absent | 5000 | 20 | $1.2 \times 10^{18}$ |
| 2 | 0.10 | Weak acid | 10 | 3000 | 19 | Absent | 0.01 | 0.01 | $1.1 \times 10^{18}$ |
| 3 | 0.110 | Weak acid | 3 | 3.5 | 10 | Absent | 0.01 | 0.01 | $3.3 \times 10^{17}$ |
| 4 | 0.110 | Weak acid | 11 | 3.5 | 10 | Absent | 0.01 | 0.01 | $7.0 \times 10^{17}$ |

-continued

| No. | RMS roughness (nm/0.2 μm□) | Final wash | Inner-packing pouch: Pre-$N_2$ intro. press. (Torr) | Inner-packing pouch: Oxygen trans. rate ($ml \cdot m^{-2} \cdot day^{-1} \cdot atm^{-1}$) | Inner-packing pouch: Moist. trans. rate ($g \cdot m^{-2} \cdot day^{-1}$) | Outer-packing pouch: Deoxygenating/dehydrating agent pres./absent | Outer-packing pouch: Oxygen trans. rate ($ml \cdot m^{-2} \cdot day^{-1} \cdot atm^{-1}$) | Outer-packing pouch: Moist. trans. rate ($g \cdot m^{-2} \cdot day^{-1}$) | Post-epi SIMS assay Interface oxy. conc. ($atoms/cm^3$) |
|---|---|---|---|---|---|---|---|---|---|
| 5 | 0.095 | Weak acid | 2 | 3.5 | 10 | Absent | 0.01 | 0.01 | $2.4 \times 10^{17}$ |
| 6 | 0.120 | Weak acid | 10 | 3.5 | 10 | Oxygen absorbent | 0.01 | 0.01 | $1.1 \times 10^{17}$ |
| 7 | 0.120 | Weak acid | 2 | 2 | 2 | Oxy. absorbent + desiccant | 0.5 | 0.7 | $1.0 \times 10^{17}$ |
| 8 | 0.120 | Weak acid | 2 | 45 | 6 | Oxygen absorbent | 5 | 3 | $1.2 \times 10^{17}$ |
| 9 | 0.120 | Weak acid | 2 | 45 | 6 | Oxygen absorbent | 0.05 | 0.4 | $1.6 \times 10^{17}$ |
| 10 | 0.110 | Weak acid | 11 | 3000 | 19 | Oxygen absorbent | 0.01 | 0.01 | $3.0 \times 10^{17}$ |
| 11 | 0.120 | Weak acid | 10 | 3.5 | 10 | Desiccant | 0.01 | 0.01 | $1.5 \times 10^{17}$ |
| 12 | 0.095 | Weak acid | 11 | 3000 | 19 | Desiccant | 0.01 | 0.01 | $3.6 \times 10^{17}$ |
| 13 | 0.110 | Weak acid | 2 | 3.5 | 10 | Absent | 5000 | 20 | $3.5 \times 10^{17}$ |
| 14 | 0.120 | Str. alkali | 11 | 3.5 | 10 | Absent | 5000 | 20 | $1.2 \times 10^{18}$ |
| 15 | 0.098 | Weak acid | 3 | 0.5 | 0.7 | Absent | 5000 | 20 | $3.4 \times 10^{17}$ |
| 16 | 0.450 | Str. alkali | 11 | 3.5 | 10 | Absent | 5000 | 20 | $3.2 \times 10^{18}$ |
| 17 | 0.350 | Weak acid | 11 | 3.5 | 10 | Absent | 5000 | 20 | $5.2 \times 10^{17}$ |
| 18 | 0.280 | Weak acid | 11 | 3.5 | 10 | Absent | 5000 | 20 | $4.7 \times 10^{17}$ |
| 19 | 0.130 | Weak acid | 3 | 100 | 15 | Oxygen absorbent | 0.05 | 0.4 | $1.4 \times 10^{17}$ |

In the table, Sample Nos. 6 through 9, 11, and 19 correspond to embodiment examples of the present invention, while Sample Nos. 1 through 5, 10, and 12 through 18 correspond to comparative examples under the present invention.

With reference to the table: As is evident from a comparison between the embodiment examples (Sample Nos. 6 through 9, 11, and 19) and the comparative examples (Sample Nos. 1 through 5, 10, and 12 through 18), from the fact that the oxygen concentration at the interface between the substrate and the epitaxial layer proves to be low when an $Al_zGa_{1-z}As$ ($0<z<1$, with $z=0.4$ in the embodiment examples) semiconductor epitaxial layer has been grown onto GaAs substrates that have been stored by placing rigid containers 20 holding GaAs semiconductor substrates (compound semiconductor substrates 10) into inner-packing pouches 30 having an oxygen transmission rate of 1 to 100 $ml \cdot m^{-2} \cdot day^{-1} \cdot atm^{-1}$, and a moisture transmission rate of 1 to 15 $g \cdot m^{-2} \cdot day^{-1}$, replacing the air inside the inner-packing pouches 30 with an inert gas, hermetically sealing the inner-packing pouch 30, placing the hermetically sealed inner-packing pouches 30, together with a deoxygenating/dehydrating agent 40, into outer-packing pouches 60 having an oxygen transmission rate that is 5 $ml \cdot m^{-2} \cdot day^{-1} \cdot atm^{-1}$ or less and is lower than that of the inner-packing pouches, and a moisture transmission rate that is 3 $g \cdot m^{-2} \cdot day^{-1}$ or less and is lower than that of the inner-packing pouches, and hermetically sealing the outer-packing pouches 60, it will be understood that oxidation of the front surface of the substrates is prevented.

The presently disclosed embodiment modes and embodiment examples should in all respects be considered to be illustrative and not limiting. The scope of the present invention is set forth not by the foregoing description but by the scope of the patent claims, and is intended to include meanings equivalent to the scope of the patent claims and all modifications within the scope.

What is claimed is:

1. A compound semiconductor substrate packaging method comprising:

a first step of inserting a compound semiconductor substrate into a gas-permeable, rigid container, placing the rigid container into a heat-sealable inner-packing pouch having an oxygen transmission rate of 1 to 100 $ml \cdot m^{-2} \cdot day^{-1} \cdot atm^{-1}$, and a moisture transmission rate of 1 to 15 $g \cdot m^{-2} \cdot day^{-1}$, replacing the air inside the inner-packing pouch with an inert gas, and heat-sealing the inner-packing pouch containing the inert gas to thereby hermetically seal the inert gas into the pouch; and a second step of placing the sealed inner-packing pouch, and a deoxygenating/dehydrating agent that absorbs or adsorbs at least either oxygen gas or moisture, into an outer-packing pouch that has an oxygen transmission rate that is 5 $ml \cdot m^{-2} \cdot day^{-1} \cdot atm^{-1}$ or less and is lower than that of the inner-packing pouch, and a moisture transmission rate that is 3 $g \cdot m^{-2} \cdot day^{-1}$ or less and is lower than that of the inner-packing pouch, and hermetically sealing the outer-packing pouch.

2. A compound semiconductor substrate packaging method as set forth in claim 1, wherein in said first step, the operation of replacing the air inside the inner-packing pouch with an inert gas is carried out by means of an operation in which a vacuum is drawn on the inner-packing pouch by exhausting the air inside, after which an inert gas is flowed into the inner-packing pouch.

3. A compound semiconductor substrate packaging method as set forth in claim 2, wherein in said first step, the pressure of the air inside the inner-packing pouch after a vacuum is drawn on the inner-packing pouch by exhausting the air inside, and prior to the inert gas being flowed into the inner-packing pouch, is 15 torr or less.

4. A compound semiconductor substrate packaging method as set forth in claim 3, wherein:

the outer-packing pouch is transparent; and in said second step, an oxygen/moisture indicator for indicating the concentration of at least either oxygen gas or moisture is also placed into the outer-packing pouch.

5. A compound semiconductor substrate packaging method as set forth in claim 2, wherein:

the outer-packing pouch is transparent; and in said second step, an oxygen/moisture indicator for indicating the concentration of at least either oxygen gas or moisture is also placed into the outer-packing pouch.

6. A compound semiconductor substrate packaging method as set forth in claim 1, wherein:

the outer-packing pouch is transparent; and in said second step, an oxygen/moisture indicator for indicating the concentration of at least either oxygen gas or moisture is also placed into the outer-packing pouch.

7. A compound semiconductor substrate packaging method as set forth in claim 1, wherein the inner-packing pouch is composed substantially of a plastic material or materials, and in said first step the heat-sealing of the inner pouch is by thermoplastic welding.

8. A compound semiconductor substrate packaging method as set forth in claim 1, wherein the outer-packing pouch is heat-sealable, and in said second step is heat-sealed to close the pouch hermetically.

* * * * *